US009743194B1

(12) United States Patent
MacLean

(10) Patent No.: US 9,743,194 B1
(45) Date of Patent: Aug. 22, 2017

(54) WOVEN TRANSDUCER APPARATUS

(71) Applicant: Sonos, Inc., Santa Barbara, CA (US)

(72) Inventor: Paul MacLean, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 15/018,785

(22) Filed: Feb. 8, 2016

(51) Int. Cl.
*H04R 9/04* (2006.01)
*H04R 31/00* (2006.01)

(52) U.S. Cl.
CPC ..... *H04R 9/043* (2013.01); *H04R 31/006* (2013.01)

(58) Field of Classification Search
CPC .... H04R 9/00; H04R 29/003; H04R 2209/00; H04R 2209/41; H04R 7/00; H04R 2207/00; H04R 2307/029
USPC ..... 381/404, 423, 426, 428
See application file for complete search history.

(56) References Cited

U.S. PATENT DOCUMENTS 5,440,644 A 8/1995 Farinelli et al.
5,761,320 A 6/1998 Farinelli et al.
5,923,902 A 7/1999 Inagaki
6,032,202 A 2/2000 Lea et al.
6,039,146 A * 3/2000 Byun ..... H04R 31/003 181/169
6,256,554 B1 7/2001 DiLorenzo
6,269,167 B1 * 7/2001 Mango, III ..... H04R 1/06 174/116
6,404,811 B1 6/2002 Cvetko et al.
6,469,633 B1 10/2002 Wachter
6,522,886 B1 2/2003 Youngs et al.
6,611,537 B1 8/2003 Edens et al.
6,631,410 B1 10/2003 Kowalski et al.
6,757,517 B2 6/2004 Chang
6,778,869 B2 8/2004 Champion
7,130,608 B2 10/2006 Hollstrom et al.
7,130,616 B2 10/2006 Janik
7,143,939 B2 12/2006 Henzerling
7,236,773 B2 6/2007 Thomas
(Continued)

FOREIGN PATENT DOCUMENTS

EP 1389853 A1 2/2004
WO 200153994 7/2001
WO 03093950 A2 11/2003

OTHER PUBLICATIONS

"AudioTron Quick Start Guide, Version 1.0", Voyetra Turtle Beach, Inc., Mar. 2001, 24 pages.
(Continued)

*Primary Examiner* — Suhan Ni
(74) *Attorney, Agent, or Firm* — McDonnell Boehnen Hulbert & Berghoff LLP

(57) ABSTRACT

Embodiments of a speaker spider for a loudspeaker or transducer are provided. The speaker spider may include a textile material formed of a woven pattern with a plurality of concentric corrugations. The weaving pattern and/or dimensions of the speaker spider may substantially homogenize and/or reduce stress on the speaker spiders during operation of the speaker. The weaving pattern of the textile material of the speaker spider may include a pattern formed of a plurality of substantially concentric circular shapes, and/or a pattern including threads tangential to the central opening.

15 Claims, 10 Drawing Sheets

(56) References Cited

U.S. PATENT DOCUMENTS

| | | | | |
|---|---|---|---|---|
| 7,274,796 | B2 * | 9/2007 | Chan | H04R 9/043 29/594 |
| 7,295,548 | B2 | 11/2007 | Blank et al. | |
| 7,382,892 | B2 * | 6/2008 | Chan | H04R 9/043 381/403 |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,657,910 | B1 | 2/2010 | McAulay et al. | |
| 7,853,341 | B2 | 12/2010 | McCarty et al. | |
| 7,987,294 | B2 | 7/2011 | Bryce et al. | |
| 8,014,423 | B2 | 9/2011 | Thaler et al. | |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,483,853 | B1 | 7/2013 | Lambourne | |
| 9,148,727 | B1 * | 9/2015 | Busenitz | H04R 7/02 |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0124097 | A1 | 9/2002 | Isely et al. | |
| 2003/0157951 | A1 | 8/2003 | Hasty | |
| 2004/0024478 | A1 | 2/2004 | Hans et al. | |
| 2005/0232458 | A1 * | 10/2005 | Hachiya | H04R 7/12 381/426 |
| 2005/0254682 | A1 * | 11/2005 | Maekawa | H04R 9/043 381/404 |
| 2007/0142944 | A1 | 6/2007 | Goldberg et al. | |
| 2007/0189576 | A1 * | 8/2007 | Chan | H04R 9/043 381/404 |
| 2016/0037264 | A1 | 2/2016 | Danovi | |

OTHER PUBLICATIONS

"AudioTron Reference Manual, Version 3.0", Voyetra Turtle Beach, Inc., May 2002, 70 pages.

"AudioTron Setup Guide, Version 3.0", Voyetra Turtle Beach, Inc., May 2002, 38 pages.

Bluetooth. "Specification of the Bluetooth System: The ad hoc SCATTERNET for affordable and highly functional wireless connectivity," Core, Version 1.0 A, Jul. 26, 1999, 1068 pages.

Bluetooth. "Specification of the Bluetooth System: Wireless connections made easy," Core, Version 1.0 B, Dec. 1, 1999, 1076 pages.

Dell, Inc. "Dell Digital Audio Receiver: Reference Guide," Jun. 2000, 70 pages.

Dell, Inc. "Start Here," Jun. 2000, 2 pages.

Jo et al., "Synchronized One-to-many Media Streaming with Adaptive Playout Control," Proceedings of SPIE, 2002, pp. 71-82, vol. 4861.

Jones, Stephen, "Dell Digital Audio Receiver: Digital upgrade for your analog stereo" Analog Stereo Jun. 24, 2000 retrieved Jun. 18, 2014, 2 pages.

Louderback, Jim, "Affordable Audio Receiver Furnishes Homes With MP3," TechTV Vault. Jun. 28, 2000 retrieved Jul. 10, 2014, 2 pages.

Palm, Inc., "Handbook for the Palm VII Handheld," May 2000, 311 pages.

Presentations at WinHEC 2000, May 2000, 138 pages.

UPnP; "Universal Plug and Play Device Architecture," Jun. 8, 2000; version 1.0; Microsoft Corporation; pp. 1-54.

"Denon 2003-2004 Product Catalog," Denon, 2003-2004, 44 pages.

U.S. Appl. No. 60/490,768, filed Jul. 28, 2003, entitled "Method for synchronizing audio playback between multiple networked devices," 13 pages.

U.S. Appl. No. 60/825,407, filed Sep. 12, 2003, entitled "Controlling and manipulating groupings in a multi-zone music or media system," 82 pages.

Yamaha DME 64 Owner's Manual; copyright 2004, 80 pages.

Yamaha DME Designer 3.5 setup manual guide; copyright 2004, 16 pages.

Yamaha DME Designer 3.5 User Manual; Copyright 2004, 507 pages.

* cited by examiner

WOVEN TRANSDUCER APPARATUS

FIELD OF THE DISCLOSURE

The disclosure is related to consumer goods and, more particularly, to methods, systems, products, features, services, and other elements directed to media playback or some aspect thereof.

BACKGROUND

The term "speaker spider" is used to refer to a mechanism that provides a centering and spring-like mechanism in a loudspeaker. Such a speaker spider helps maintain a concentric position of a voice coil relative to a magnetic assembly of the loudspeaker, and a neutral axial position within the loudspeaker. The speaker spider may be under stress during operation of the loudspeaker. Accordingly, a longevity of the loudspeaker may depend on a durability of the speaker spider.

BRIEF DESCRIPTION OF THE DRAWINGS

Features, aspects, and advantages of the presently disclosed technology may be better understood with regard to the following description, appended claims, and accompanying drawings where:

Figure 1A:
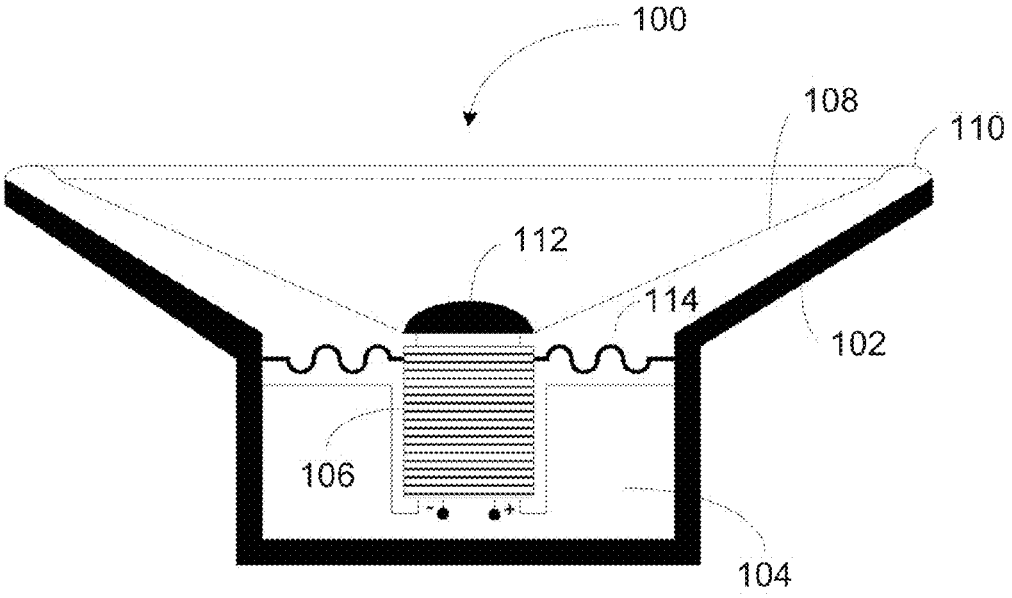
FIGS. 1A-1C show cross-sectional views of examples of transducer apparatuses according to aspects described herein.

The drawings are for the purpose of illustrating example embodiments, but it is understood that the inventions are not limited to the arrangements and instrumentality shown in the drawings.

DETAILED DESCRIPTION

I. Overview

Some embodiments described herein involve speaker spiders including a textile material that is woven non-linearly and/or in a manner that one or more threads are tangential to an inner dimension defining a central opening of the speaker spider. The embodiments described herein may produce speaker spiders which can disperse stress more evenly and/or reduce stresses of the textile material caused by the weaving pattern of a conventional plain weave speaker spider. The embodiments described herein can result in a more reliable transducer and/or playback device because of the more evenly distributed, randomized and/or reduced stresses.

In one embodiment, the textile material may include warp threads and weft threads. The warp threads may be woven spirally to form substantially concentric circles. The weft threads may extend linearly along radii of the spider.

In some embodiments, the textile material may include a central opening defining an inner dimension or perimeter. The warp thread may be woven spirally to form substantially concentric circles between an inner dimension and an outer dimension of the speaker spider.

In another embodiment, the textile material may include a woven pattern of threads crossing over each other where a thread in the base pattern may be tangential to the inner dimension of the spider.

In yet another embodiment, the textile material include a woven pattern formed from a shaped base which is repeated coaxially around the spider where one or more threads in the base pattern is tangential to the inner dimension of the speaker spider.

The textile material of some speaker spiders may be formed from a combination of different embodiments and/or different number of woven layers of the different embodiments. In each of these embodiments, speaker spiders may have one or more corrugations.

As indicated above, the examples provided herein may be apparatuses such as a speaker spider apparatus, a transducer apparatus, or a playback device including the speaker spider apparatuses described herein.

In one aspect, a method is provided. The method may involve providing the woven textile or fabric, shaping the woven textile to include corrugations, and attaching the woven textile to a frame of the transducer apparatus.

As noted above, example apparatuses may involve a speaker spider including a textile material that is woven non-linearly and/or in a manner that one or more threads are tangential to an inner dimension defining a central opening of the speaker spider. In one aspect, an apparatus may include an outer edge defining an outer perimeter or circumference. The apparatus may include a textile material formed of a woven pattern and comprising a plurality of concentric corrugations configured to allow movement of a loudspeaker component coupled to the apparatus. The woven pattern may include interwoven threads extending between distributed points along the outer edge. The interwoven threads may include pairs of threads having outer ends positioned within an outer common area distributed along the outer edge.

In some aspects, the textile material may include a central opening defining an inner perimeter or circumference, and the woven pattern may include interwoven threads defining the central opening and extending between distributed points on the inner perimeter and outer perimeter.

In some aspects, the apparatus may include an outer edge defining an outer perimeter; and a textile material. The textile material may be formed of a woven pattern and include a plurality of concentric corrugations configured to allow movement of a loudspeaker component coupled to the textile material. The woven pattern may include interwoven threads extending between distributed points along the outer edge, and the interwoven threads may include pairs of threads, each pair of threads having outer ends positioned within a common area along the outer edge.

In another aspect, an apparatus may be a transducer apparatus. The transducer apparatus may include a speaker spider with an outer perimeter, and a textile material. The textile material can be formed of a woven pattern with the woven pattern including interwoven threads extending between distributed points along the outer edge. The interwoven threads may include pairs of threads with each pair of threads having outer ends positioned within a common area along the outer edge. In some aspects, the speaker spider may include a central opening that may define an inner perimeter of the speaker spider.

In yet another aspect, example techniques described herein may involve producing a woven speaker spider. In one example, a method for producing the woven speaker spider may be provided. The method may include providing a textile material formed of a woven pattern which includes interwoven threads extending between distributed points along an outer perimeter. The interwoven threads comprising pairs of threads with each pair of threads having outer ends positioned within a common area along the outer edge. The textile material may be processed to form a plurality of concentric corrugations configured to allow movement of a voice coil coupled to the inner circumference. The method may further include coupling the textile material to at least one of a voice coil on the inner circumference or a frame on the outer circumference.

While some examples described herein may refer to functions performed by given actors such as "users" and/or other entities, it should be understood that this is for purposes of explanation only. The claims should not be interpreted to require action by any such example actor unless explicitly required by the language of the claims themselves. It will be understood by one of ordinary skill in the art that this disclosure includes numerous other embodiments.

II. Example Loudspeaker Device

Figure 1B:
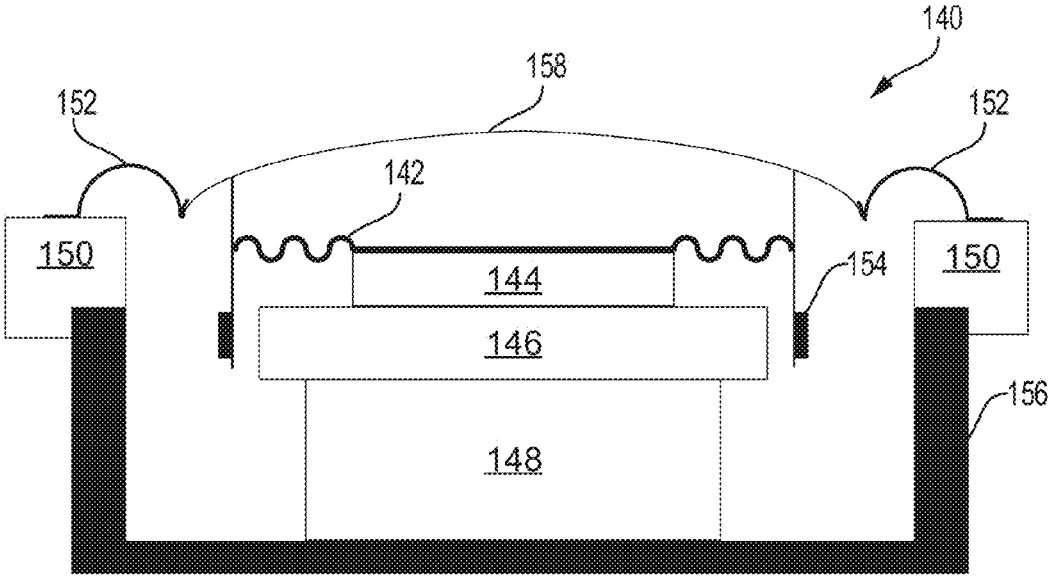
Figure 1C:
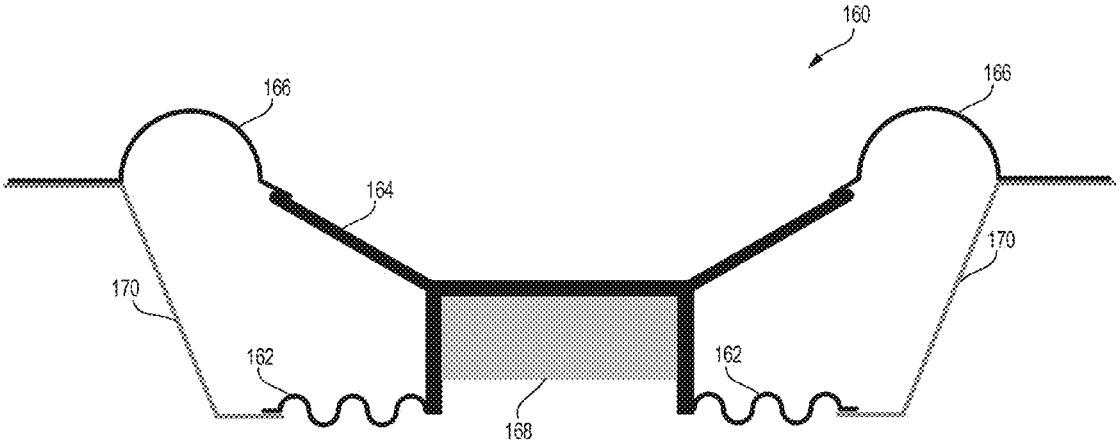

FIGS. 1A, 1B, and 1C show illustrative examples of loudspeakers 100, within which an apparatus such as that described herein may be implemented as a speaker spider. As shown, the loudspeaker 100 may include a speaker frame (or "basket") 102 and a magnetic structure 104 having a central portion. A voice coil 106 may be mechanically suspended about the center portion of the magnetic structure 104 by coupling voice coil 106 to a speaker cone 108 that is further coupled to the speaker frame 102 via a surround 110. The voice coil 106, as shown, may have a positive and negative terminal through which electric signals may be provided to drive the voice coil along the center portion of the magnetic structure 104. Movement of the speaker cone 108 when the voice coil 106 is driven may cause sound to be produced. A dust cap 112 may cover the voice coil 106 to protect the voice coil 106 from external debris.

FIG. 1A shows a cross-sectional view of the example loudspeaker 100 which includes a spider 114 coupling the speaker frame 102 to the voice coil 106. The speaker spider 114 may have a plurality of concentric corrugations that provide a spring-like mechanism to allow movement of the voice coil 106 relative to the speaker frame 102 when the voice coil 106 is driven during operation, while maintaining a concentric position of the voice coil relative to a magnetic assembly of the loudspeaker. In other words, in addition to being a centering mechanism, the speaker spider can act as a spring (with an associated stiffness versus displacement), providing a restoring force on the cone and voice coil assembly to ensure these parts do not move inward or outward farther than intended. In one example, an apparatus such as those described herein may be implemented as the speaker spider 114 of the loudspeaker 100 shown in FIG. 1. The loudspeaker 100 may be coupled to an audio amplifier from which an audio signal to be rendered by the loudspeaker 100 may be received. Other examples are also possible.

FIG. 1B shows another example of a loudspeaker 140. Loudspeaker 140 may include a speaker spider 142, a spacer 144, a steel washer 146, a magnet 148, a carrier 150, a surround 152, a voice coil 154, a steel cup 156, and a diaphragm or speaker cone 158. Speaker spider 142 may be disposed within voice coil 154. In this example, the speaker spider 142 might not have a central opening and may be attached on one side at the center to a first side of a spacer or magnet 144. The outer dimension or perimeter of speaker spider 142 may be coupled to the inner side of voice coil 154. Spacer 144 may be attached to a washer 146 (e.g., steel washer) on a second side opposing the first side of spacer 144. For example, spacer 144 may be attached to speaker spider 142 and/or washer 146 using an attachment mechanism (e.g., glue). Spacer 144 may be immobile such that movement of voice coil 154 causes displacement of the outer dimension or perimeter of speaker spider 142 relative to the center of speaker spider 142. One end of voice coil 154 can be attached to diaphragm 158, and surround 152 may be attached between diaphragm 158 and carrier 150. Speaker spider 142, spacer 144, washer 146, and magnet 148 may be stacked within a steel cup 156. Carrier 150 may be placed on top of steel cup 156 between surround 152 and steel cup 156. Examples of types of loudspeakers that may use this arrangement of components include a mid-range speaker, a woofer, and a passive radiator.

FIG. 1C shows yet another example of a loudspeaker 160. Loudspeaker 160 includes a speaker spider 162, diaphragm or cone 164, surround or suspension 166, suspended mass 168, and frame or basket 170. Speaker spider 162 may be attached at the center in the central opening to a diaphragm 164 containing a hanging mass or weight 168 which is suspended from the center of the diaphragm 164, and the hanging mass or weight 168 may be placed within a frame or container of diaphragm 164 on the side within frame 170. In some aspects, speaker spider 162 may be connected directly to hanging mass or weight 168 which is suspended from the center of diaphragm 164. The outer perimeter or edge of speaker spider 162 may be attached to frame 170. Loudspeaker 160 may be a passive radiator.

III. Example Speaker Spiders

As discussed above, embodiments described herein may relate to speaker spider apparatuses which have a particular woven pattern. Different woven patterns or combinations of woven patterns described herein may be used for the textile material to produce a speaker spider which can more evenly disperse and/or reduce stresses influenced by the weaving pattern of the textile material during use of the speaker spider.

In some conventional speaker spiders, the speaker spiders may use a plain weave where warp and weft threads cross each other at 90 degree angles resulting in an anisotropic textile material. The material can stress or stretch differently in different directions resulting unpredictable qualities including non-linear high stress points in the speaker spider. If dimensions of the speaker spider are circularly symmetrical and independent of the directions of the weaving, a flexibility of the speaker spider may vary depending on a direction of an external force. For instance, the speaker spider may be more flexible in a first direction that is perpendicular (or parallel) to a direction of the warp threads or weft threads, and less flexible in a second direction that is 45 degrees from a direction of the warp threads or weft threads. As such, during operation of the loudspeaker, a force pulling on the spider in the second direction may generate more stress on the speaker spider than the same force pulling on the spider in the first direction. High stress areas on a speaker spider have may have an increased chance of cracking or tearing, and may be points of failure that compromise the longevity of the speaker spider. Such non-linear high stress points may manifest in a buckling motion or rocking motion.

The buckling motion in conventional speaker spiders may appear when displacement of the speaker spider reaches a threshold where plain weave weft and warp threads are unequally stressed, for example, when the voice coil to which the conventional speaker spider is attached is displaced. As a result, creases caused by internal stresses on the fabric may become present in the textile material causing the fabric to quickly and suddenly distort in trying to relieve the internal stresses. During these stress-relief events, the local stress along the 45 degree direction may increase considerably compared to other directions in the textile which may compromise long-term reliability. Because the formation of the creases can happen rapidly during dynamic displacement of the voice coil an objectionable snapping sound may be heard.

Another motion that may appear when a plain weave speaker spider is under non-linear, non-axisymmetric stress is a rocking motion. Rocking motion can occur when a buckling motion happens in a non-concentric or non-time aligned way on the plain weave speaker spider. For example, if one side of the plain weave speaker spider manifests the creases but the other side of the plain weave speaker spider has not yet manifested creases at that given displacement, then the stiffness of the spider is no longer axisymmetric. This lack of axisymmetry can cause the voice coil to move up and down with a side-to-side rocking motion. This rocking motion may reduce the clearance between the voice coil's outside diameter and the electromagnetic motor's (e.g., magnetic structure 104) internal diameter. If the voice coil comes in contact with the motor while the coil is in motion, an objectionable rubbing or buzzing sound may be heard.

The embodiments described herein may produce speaker spiders which can disperse stress more evenly and/or reduce stresses of the textile material influenced by the weaving pattern of a plain weave speaker spider. Further, the speaker spider embodiments described herein can be more dimensionally stable under displacement conditions resulting in a higher performing and more reliable transducer and/or playback device. For example, the speaker spider embodiments described herein may reduce buckling motion and rocking motion during movement or displacement of the voice coil. Rocking motion due to break-in of the transducer or loudspeaker apparatus may be reduced. The speaker spiders described herein may be characterized by other advantages and/or beneficial features as well.

A. First Example Speaker Spider

Figure 2:
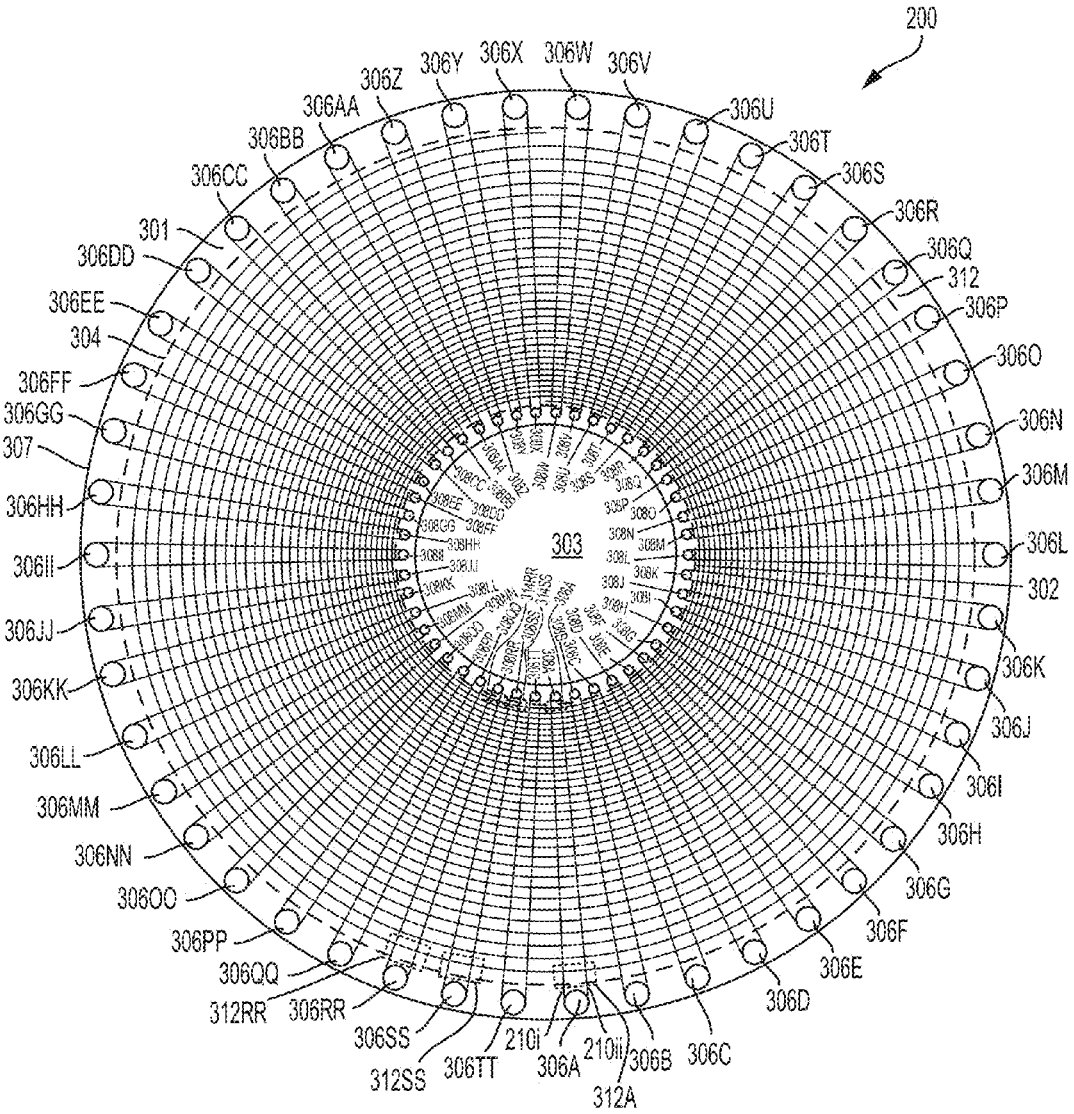
FIG. 2 shows a first example of a speaker spider according to aspects described herein.

FIG. 2 shows an example of a speaker spider 300 according to aspects described herein. The speaker spider may be formed of a woven textile material 301 having an inner dimension 302 and an outer dimension 304. Speaker spider 300 may generally have a circular shape. Inner dimension 302 may define a central circular opening 303 for a voice coil and may be coupled to voice coil 112. Inner dimension 302 may be the circumference of the central opening. Inner dimension or perimeter 302 may be defined by the innermost thread of the textile material 301. Outer dimension 304 may define an outer edge, perimeter, or circumference of the textile material 301 and may be the outermost thread of the textile material 301. Frame 102 may be coupled to outer dimension 304.

During the weaving process, the weave pattern of the textile material 301 may be produced while attached to one or more weaving frames. A weaving frame may include a plurality of outer anchor points 306 (306A, 306B, 306C, etc.) and/or a plurality of inner anchor points 308 (308A, 308B, 308C, etc.) to which threads of the textile material 301 may be coupled or attached. After completion of the weaving process, the textile material 301 may be removed from the weaving frame to form the inner dimension or perimeter 302 and outer dimension or perimeter 304 of speaker spider 200. For example, separately or in conjunction with other processes described herein, textile material 301 may be cut off or otherwise removed from the weaving frame at points of the thread which intersect with outer dimension 304. The thread may further be trimmed to remove excess thread, for example, so that the textile material is congruent to outer dimension 304.

Inner dimension 302 may be on the outer side of inner anchor points 306 such that once textile material 301 is removed from the weaving frame, inner anchor points 306 may be located within the central opening defined by inner dimension 302. Outer dimension 304 may be on the inner side of outer anchor points 306 such that once removed from the weaving frame outer anchor points 306 may be common points beyond or outside of outer dimension 304. Once removed from the weaving frame, outer ends of threads (e.g., 210*i* and 210*ii*) associated with the same anchor point (e.g., 306A) may be positioned within an outer common area (e.g., 312A) of speaker spider 300. Similarly, outer ends of threads associated with anchor point 306RR may be positioned within outer common area 312RR which is near or along outer dimension or edge 304. Because common areas 312 (e.g., 312A . . . 312TT) (not all outer common areas are explicitly shown) are associated with anchor points, distribution of common areas 312 around the outer edge 304 may be the same as distribution of the outer anchor points 306.

Similar to outer common areas 312, speaker spider may have inner common areas 314 (e.g., 314A . . . 314TT) (not all inner common areas are explicitly shown). Each inner common area 314 may be associated with an inner anchor point 308. For example, inner common area 314 RR may be associated with inner anchor point 308RR. As another example, inner common area 314A may be associated with inner anchor point 308A. Inner ends associated with the same inner anchor point may be positioned within the same inner common area which is located along or on inner dimension 302. For example, threads 210*i* and 210*ii* are both associated with inner anchor point 308A, and the inner ends of threads 210*i* and 210*ii* are positioned within inner common area 314A.

During the weaving process, anchor points on or along inner dimension 302 and outer dimension 304 may fix, anchor, or fasten ends of the threads forming the textile material 301. For example, inner dimension 302 may have a plurality of inner anchor points 308 (308A, 308B, 308C, etc.), and outer dimension 304 may have a plurality of outer anchor points 306 (306A, 306B, 306C, etc.). There may be a one-to-one correspondence between inner anchor points 308 and outer anchor points 306. In other words, an outer anchor point (e.g., anchor point 306A) may be paired with an inner anchor point (e.g., anchor point 308A). Paired anchor points may be located on or along the same radius of speaker spider 300. Inner anchor points 306 and outer anchor points 308 may be located on the same or different weaving frame 307.

Anchor points may be distributed evenly around or along inner dimension 302 and outer dimension 304. For example, an inner anchor point and corresponding outer anchor point may be placed every X number of degrees around speaker spider 300. The number of degrees may be determined based on the number of anchor points used on speaker spider 300 (e.g., X=(number of pairs of anchor points/360)). Generally, the longer or larger the diameter of speaker spider 300, the more pairs of anchor points may be used to provide a minimum strength or stiffness for speaker spider 300.

The weaving pattern may include a plurality of weft threads 210 (210*i*, 210*ii*, 210*iii*, 210*iv*, etc.) and a plurality of warp threads 312 (312*i*, 312*ii*, 312*iii*, 312*iv*, etc.). The inner ends of the weft threads 210 may be anchored at inner anchor points 308, and the outer ends of the weft threads 210 may be anchored at outer anchor points 306. For example, the ends of the weft threads may be wrapped or looped around corresponding inner and outer anchor points. In some aspects, the weft threads may be different individual pieces of yarn, and the ends of the weft threads may be attached or otherwise fixed at the anchor points using any other attachment means (e.g., glued, pinned, fastened, etc.). The warp threads 312 may be one or more threads which are woven through the weft threads to form substantially concentric circles (e.g., spiral shape) between inner dimension 302 and outer dimension 304. The warp threads may be alternately woven over and under each weft thread. Each warp thread may be one or more complete concentric circle or substantially concentric circle (e.g., spiral). The warp threads 312 may in aggregate extend from an inner point to the outer edge. The inner point may be along or on the inner dimension 302. The yarn used for the warp threads and/or weft threads may be one continuous yarn, several individual yarns attached to form a continuous yarn, and/or each thread may be an individual yarn. Different types of yarn may be used for the warp threads and the weft threads. For example, the warp thread may be a first type of yarn (e.g., Nomex), and the weft thread may be another type of yarn (e.g., cotton, polyester).

In some aspects, the number of weft threads between each weave may be varied. For example, a warp thread may be alternately woven over or under every two weft threads. Combinations of different numbers of weft threads between each weave can be used such as weaving under every three weft threads and weaving over every two weft threads. Each warp thread may abut one or more neighboring warp threads along the entirety of the warp thread to form a tightly woven textile material. Further, the warp threads and weft threads may be threaded with sufficient or the same tension to minimize any slack which may cause uneven flexibility in the textile material.

In some aspects, different numbers of warps and/or wefts may be used to control and vary the textile density, stiffness, and geometric stability. In another aspect, the different number of warps and/or wefts may be based on the diameter or thickness of yarn used for the warp and/or weft. Various yarn thicknesses may be used to achieve different stiffness versus voice coil displacement performance and break-in stability.

The weft stresses in the weave pattern of speaker spider 300 can be parallel to the diameter of central opening 303 and co-linear to the weft threads, and the warp stresses can be parallel to the diameter of central opening 303 for uniform stretch and flex proportional to the applied displacement. This distributes the typical weaknesses at the crossing points found in the plain weave and minimizes weave-related causes of buckling.

B. Second Example Speaker Spider

Figure 3:
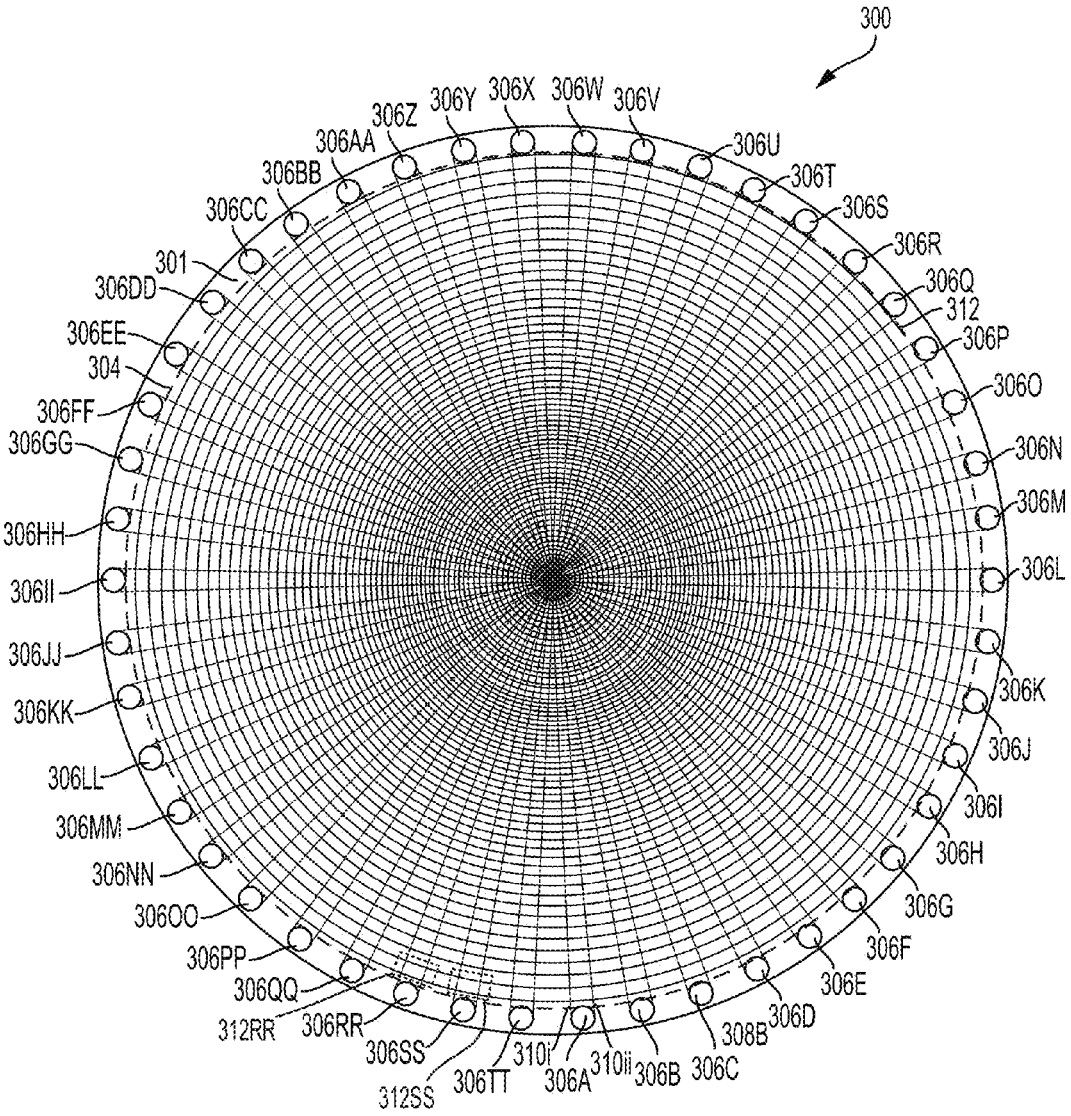
FIG. 3 depicts a second example of a speaker spider according to aspects described herein.

FIG. 3 shows another example of a speaker spider 300 according to aspects described herein. Speaker spider 300 has numerous similarities to speaker spider 200. Like numbering has been used for like features from speaker spider 200. In particular, speaker spider 300 may be formed of woven textile material 301 without central circular opening 303. In other words, speaker spider 300 may use the same weaving pattern for textile material 301 as speaker spider 200 with the weaving being present throughout speaker spider 300. Speaker spider 300 may generally have a circular shape and outer dimension 304 may define an outer edge or circumference of textile material 301. Speaker spider 300 may be removed from a weaving frame upon or after completion of the weaving process separately or in conjunction with other processes described herein. Outer anchor points 306 (306A, 306B, 306C, etc.) in speaker spider 300 may possess similar features as outer anchor points 306 of speaker spider 200. In some aspects, the weft threads may be different individual pieces of yarn, and the ends of the weft threads may be attached or otherwise fixed at the anchor points using any other attachment means (e.g., glued, pinned, fastened, etc.).

Once removed from the weaving frame, outer ends of threads (e.g., 210*i* and 210*ii*) associated with the same anchor point (e.g., 306A) may be positioned within an outer common area (e.g., 312A) associated with the anchor point (e.g., 306A) of speaker spider 300. Similarly, outer ends of threads associated with anchor point 306RR may be positioned within outer common area 312RR near or along outer dimension or edge 304. Because common areas 312 (e.g., 312A . . . 312TT) are associated with anchor points, distribution of common areas 312 around the outer edge 304 may be the same as distribution of the outer anchor points 306.

Speaker spider 300 may have a plurality of weft threads 310 (310*i*, 310*ii*, 310*iii*, 310*iv*, etc.) and a plurality of warp threads 312 (312*i*, 312*ii*, 312*iii*, 312*iv*, etc.). Ends of weft threads 310 may be anchored at outer anchor points 306. For example, the ends of the weft threads may be wrapped or looped around outer anchor points 306. Warp threads 312 of speaker spider 300 may have same or similar characteristics as warp threads 312 of speaker spider 200. Warp threads 312 The warp threads 312 may be one or more threads which are woven through the weft threads to substantially form concentric circles (e.g., spiral shape) between inner dimension 302 and outer dimension 304. The warp threads may be alternately woven over and under each weft thread. Each warp thread may be one or more complete or substantially concentric circle. The warp threads may extend from an inner point (e.g., center of speaker spider 300) to outer dimension 304. The yarn used for the warp threads and/or weft threads may be one continuous yarn, several individual yarns attached to form a continuous yarn, and/or each thread may be an individual yarn.

As described herein, inside a loudspeaker 140, a spacer may be affixed to one side of speaker spider 300, and the outer edges of speaker spider 300 may be coupled to an internal face of a voice coil such that movement of the voice coil causes displacement of the outer edges of speaker spider 300. The spacer may maintain positioning of the center of speaker spider 300 in a stable or substantially stable position such that displacement of the outer edges moves relative to the center of speaker spider 300.

Similar to speaker spider 200, outer dimension 304 may be on the inner side of outer anchor points 306 such that once removed from the weaving frame outer anchor points 306 may be common points beyond or outside of outer dimension 304.

In the spiral weaving shown in FIGS. 2 and 3 for speaker spiders 200 and 300, respectively, some spacing is shown between neighboring spirals for the sake of illustration in order to more clearly show the individual threads in the weaving pattern of textile material 301. In some aspects, neighboring spirals may be adjacent such that there is no visible space between them. In other words neighboring spirals may touch each other to form a tightly woven textile material 301.

C. Third Example Speaker Spider

Figure 4A:
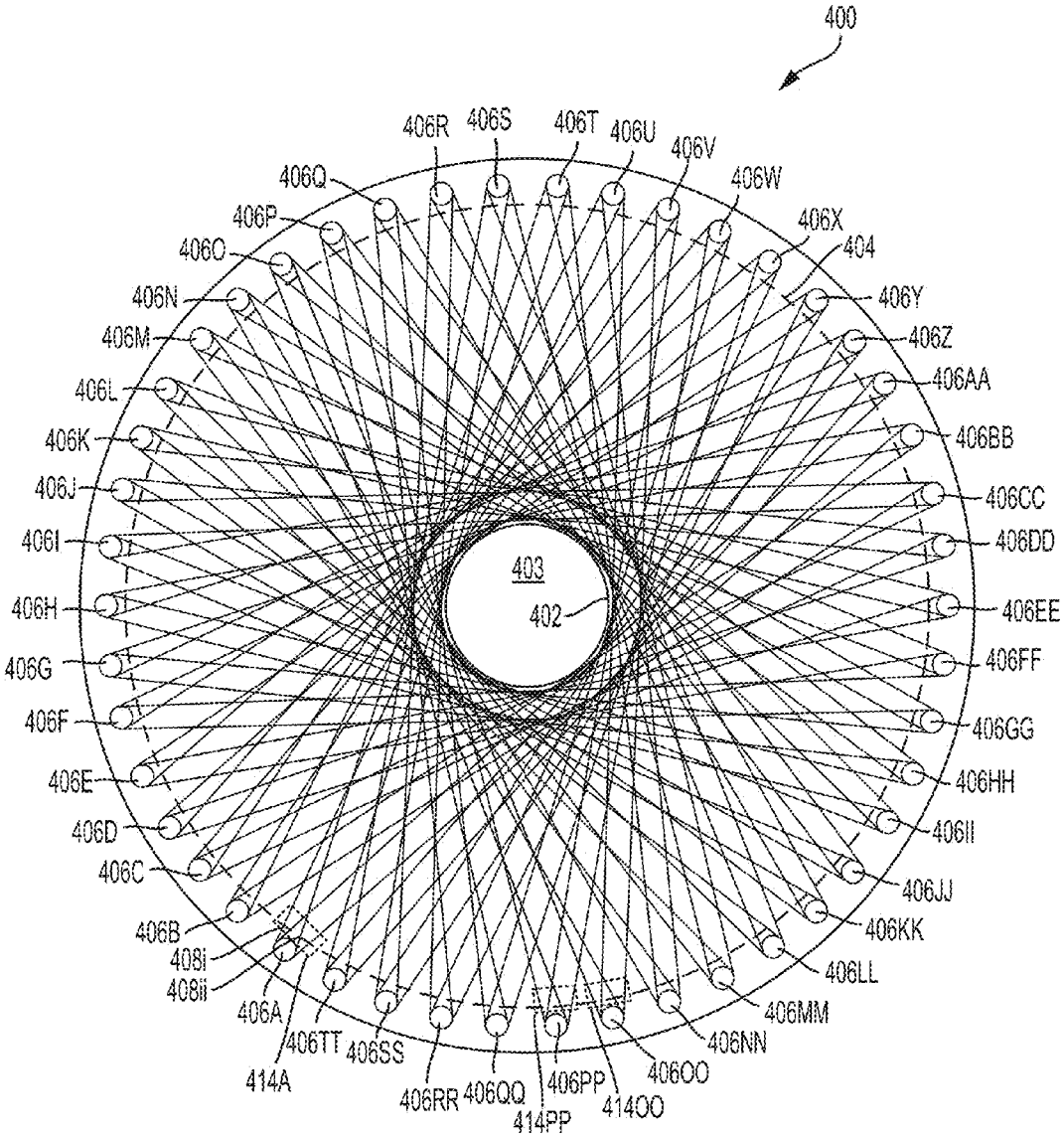
FIG. 4A shows a third example of a speaker spider according to aspects described herein.
Figure 4B:
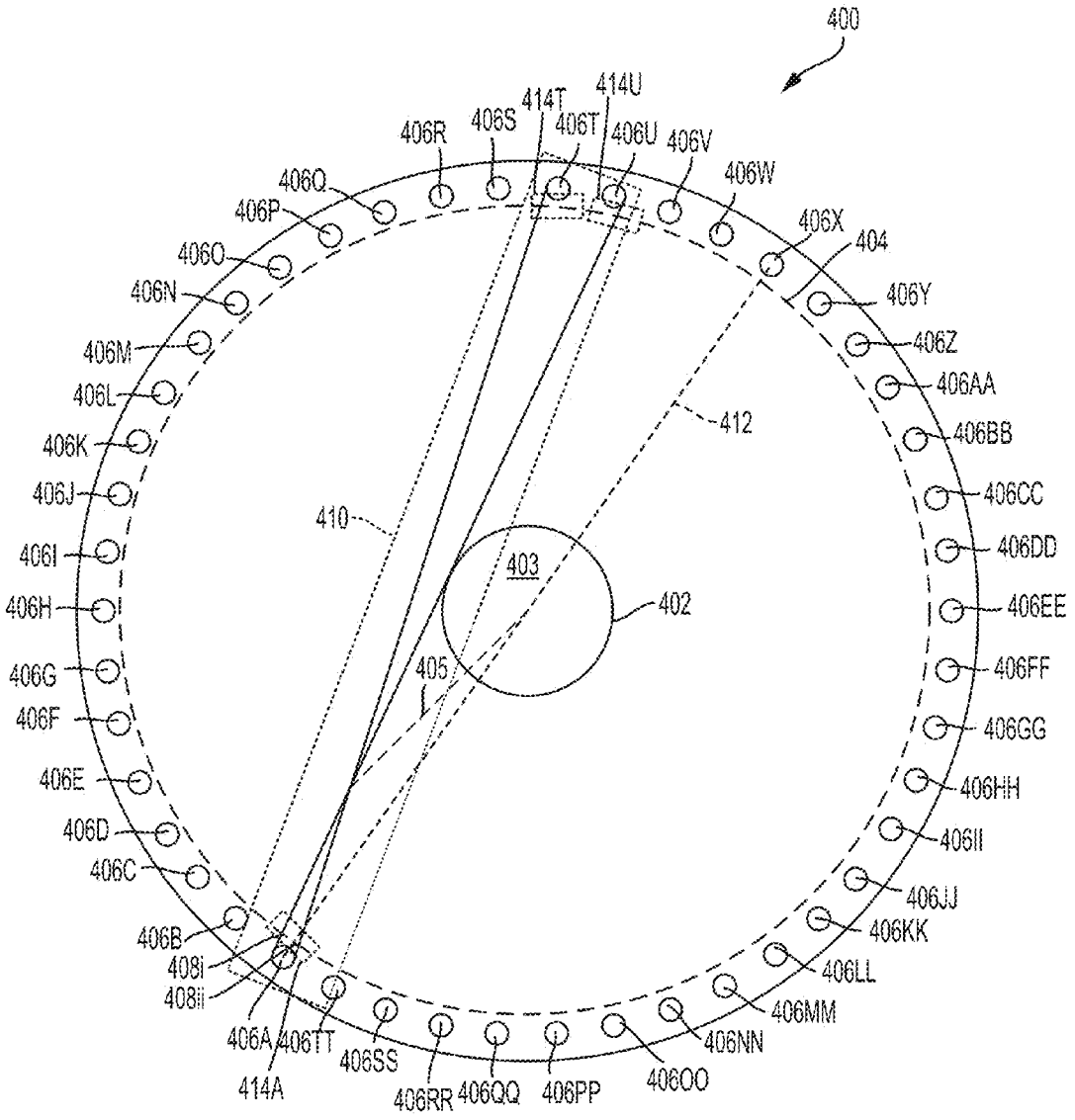
FIG. 4B illustrates an example of a base pattern of the third example of the speaker spider shown in FIG. 4A according to aspects described herein.

FIGS. 4A and 4B show another example of a speaker spider 400 according to aspects described herein. FIG. 4A provides an overview of speaker spider 400, and FIG. 4B provides a view of an underlying base pattern of speaker spider 400. Speaker spider 400 may include an inner dimension 402 and an outer dimension 404. Similar to speaker spider 300, inner dimension 402 may be coupled to voice coil 106 and define a central opening, and outer dimension 404 may be coupled to frame 102. Speaker spider 400 may use a weave pattern where the weave inherently forms the inner dimension 402. In other words, threads 408 of the weave pattern may be strung or woven in such a manner that the threads along different chords of speaker spider 400 may be tangential to inner dimension 402. The combination of all the threads or the threads in aggregate in the woven pattern can define inner dimension 402. A plurality of outer anchor points 406 may be distributed evenly on or along outer dimension 404 similar to speaker spider 300. Also similar to speaker spider 300, outer dimension 404 may be on the inner side of outer anchor points 406. The weave pattern may be formed of a base pattern which is rotated and repeated co-axially around speaker spider 400. In repeating the base pattern co-axially around speaker spider 400, the shared axis of each base pattern may be an axis perpendicular to the center of speaker spider 400. The base pattern may include a set of threads and anchor points or common areas associated with anchor points which will be described in more detail with respect to FIG. 4B.

Similar to speaker spiders 200, 300, speaker spider 400 may be removed from a weaving frame after completion of the weaving. Outer dimension 404 may be on the inner side of outer anchor points 406 such that once removed from the weaving frame outer anchor points 406 may be common points beyond or outside of outer dimension 404. Once removed from the weaving frame, outer ends of threads (e.g., 408*i* and 408*ii*) associated with the same anchor point (e.g., 406A) may be positioned within an outer common area (e.g., 414A) of speaker spider 400. Similarly, outer ends of threads associated with anchor point 406PP may be positioned within outer common area 414PP which is near or along outer dimension or edge 404 and within vicinity of the associated anchor point 406PP. Because common areas 414 (e.g., 414A . . . 414TT) (not all outer common areas are explicitly shown) are associated with anchor points, distribution of common areas 414 around the outer edge 404 may be the same as and/or correspond to distribution of the outer anchor points 406.

FIG. 4B shows base pattern 410 in more detail. Base pattern 410 may include a set of two threads 408*i*, 408*ii* and three anchor points 406A, 406T, 406U or outer common areas associated with the three anchor points, 414A, 414T, 414U, respectively. Anchor points 406T (and outer common area 414A), 406U (and associated outer common area 414U) may be neighboring anchor points on outer dimension 404 opposite anchor point 406A and on the same side of a diameter 412 of speaker spider 400 starting at the first anchor point 406A. The first ends of the two threads 408*i*, 408*ii* may be on opposing sides of anchor point 406A on outer dimension 404. Thread 408*i* may be tangential to inner dimension 402. The first end of thread 408*i* may be attached on the side of anchor point 406A in the same half of speaker spider 400 based on diameter 404. The second end of first thread 408*i* may be connected or attached to anchor point 406U on the side of anchor point 406U on outer dimension 404 which is closer to diameter 412 of speaker spider 500. The second end of second thread 408*ii* may be attached or coupled to anchor point 406T on the side of anchor point 406T which is further away from diameter 412 along the outer dimension 404. In other words, first thread 408*i* and second thread 408*ii* may be threaded such that the threads 408*i* and 408*ii* intersect at a radius 405 from the center of speaker spider 400. Once removed from the weaving frame, ends of threads 408*i* and 408*ii* may be positioned within common areas 414A, 414T, and 414U which are associated with anchor point 406A, anchor point 406T, and anchor point 406U, respectively.

Base pattern 410 may be repeated throughout speaker spider 400 with each anchor point or associated outer common area being the first anchor point or common area of base pattern 410 at least once. For continuity and/or uniformity in the speaker spider weaving base pattern 410 may be repeated in a clockwise or counter-clockwise direction. For example, anchor point 406A may be the initial first anchor point of base pattern 410 followed by using an immediately neighboring anchor point in the clockwise direction (e.g., anchor point 406B) as the next first anchor point of base pattern 410. The yarn used for the threads may be one continuous yarn, several individual yarns attached to form a continuous yarn, and/or each thread may be an individual yarn.

Base pattern 410 shown in and described with respect to FIGS. 3A and 3B is merely one example base pattern. Other base patterns and variations are possible. For example, the second and third anchor points might not be immediate neighbors. One or more anchor points (e.g., anchor point T) may be intermediate to the second anchor point (e.g., anchor point 406S) and the third anchor point (e.g., anchor point 406U) such that radius 405 of the intersection points of the threads may be increased. As another example, the angle between first thread 408*i* and diameter 412 may be reduced to change the diameter of the central opening. Similarly, the angle can be enlarged by changing the second anchor point and third anchor point to anchor point 406T and anchor point 406U, respectively.

The weave pattern of speaker spider 400 may produce textile or fabric material with a fabric density distribution that is densest at the inner diameter and least dense at the outer diameter. The density can decrease at a smooth progressive manner. The fabric material's anisotropic Young's Modulus may follow the same relative trend as the density, namely, decreasing from the inner dimension towards the outer dimension. The material parameters around the circumference at any specified diameter of speaker spider 400 are now mostly randomized tangential to a diameter of central opening 403 but also largely consistent around the circumference for any given radius for speaker spider 400. This improved material property consistency means that stresses can be more evenly distributed over the entirety of speaker spider 400.

C. Fourth Example Speaker Spider

Figure 5:
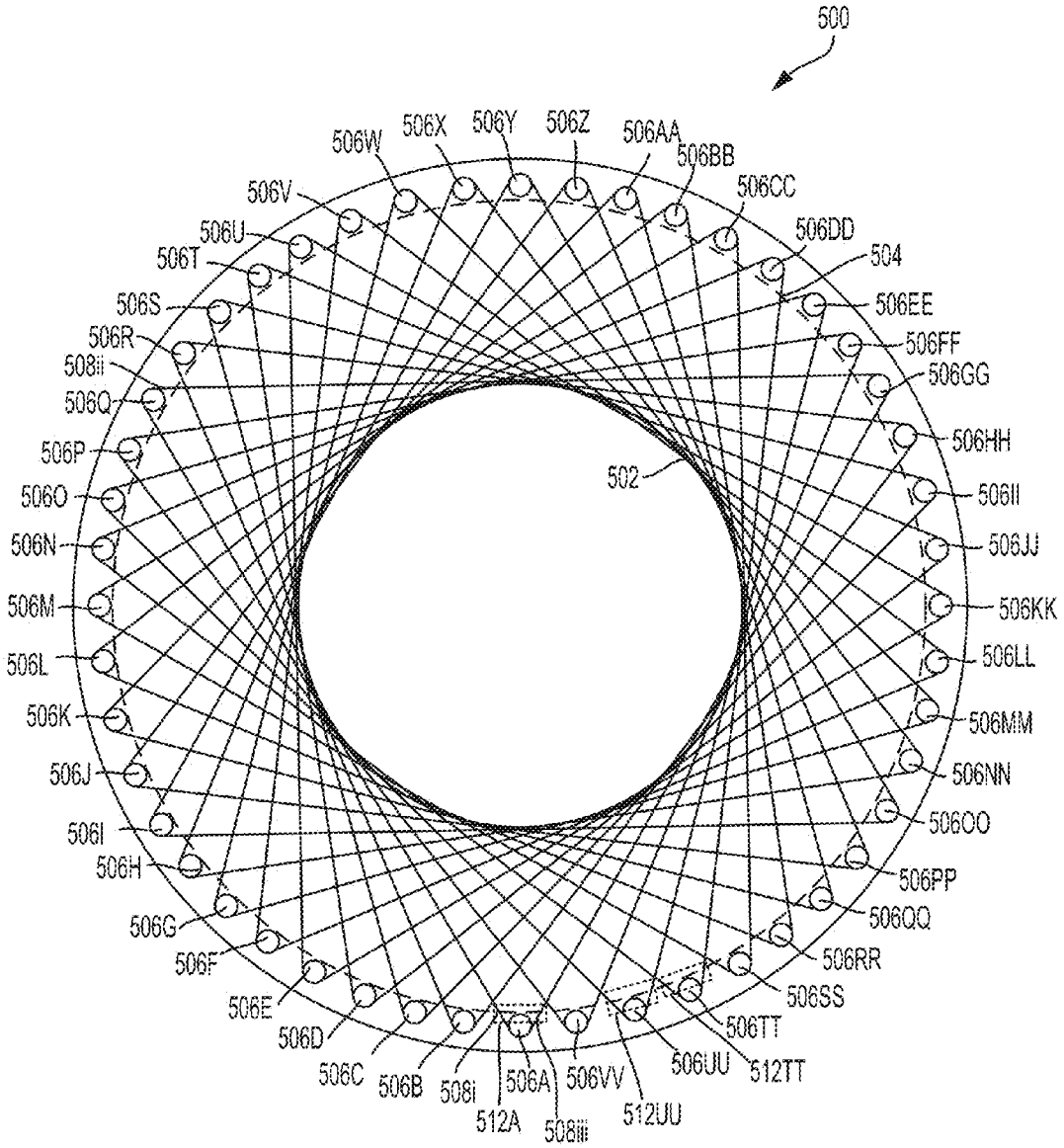
FIG. 5 shows a fourth example of a speaker spider according to aspects described herein.

FIG. 5 illustrates an example of a speaker spider 500 according to aspects described herein. Similar to speaker spider 400, speaker spider 500 may include an inner dimension 502 and an outer dimension 504. Similar to speaker spider 400, inner dimension 502 may be coupled to voice coil 106 and define a central opening, and outer dimension 504 may be coupled to frame 102. Speaker spider 500 may use a weave pattern where the weave inherently forms the inner dimension 402. In other words, threads 508 of the weave pattern may be strung or woven in such a manner that the threads along different chords of speaker spider 400 may be tangential to inner dimension 502. The combination of all the threads or the threads in aggregate in the woven pattern can define inner dimension 402. A plurality of outer anchor points 506 (506A, 506B, etc.) may be distributed evenly on or along outer dimension 404 similar to speaker spider 400. Also similar to speaker spider 400, outer dimension 504 may be on the inner side of outer anchor points 506.

Speaker spider 500 may use a weave pattern having a specific shape as a base pattern 508. Some of the shapes may be, for example, geometric shapes (e.g., triangle, rectangle, etc.) and/or irregular shapes. For example, FIG. 4 shows a weave pattern using a geometric shape of a triangle as base pattern 508. Base pattern 508 may be repeated co-axially around speaker spider 500 (e.g., around the center point of speaker spider 500) to form the woven pattern of speaker spider 500. Example base pattern 508 includes three threads (e.g., first thread 508*i*, second thread 508*ii*, third thread 508*iii*) and three anchor points (e.g., first anchor point 506A, second anchor point 506Q, third anchor point 506GG). First thread 508*i* may be connected between first anchor point 506A and second anchor point 506Q, second thread 508*ii* may be connected between second anchor point 506Q and third anchor point 506GG, and third thread 508*iii* may be connected between third anchor point 506GG and first anchor point 506A. Base pattern 508 may be repeated around speaker spider 500 until each anchor point has been used as a first anchor point of base pattern 508. For additional layers, base pattern 508 may be repeated co-axially until each anchor point has been used as a first anchor point two or more times. In repeating base pattern 508 co-axially, the share axis may be an axis perpendicular to the center of speaker spider 500.

Similar to speaker spiders 200, 300, 400, speaker spider 500 may be removed from a weaving frame after completion of the weaving. Outer dimension 504 may be on the inner side of outer anchor points 506 such that once removed from the weaving frame outer anchor points 506 may be common points beyond or outside of outer dimension 504. Once removed from the weaving frame, outer ends of threads (e.g., 508*i* and 508*iii*) associated with the same anchor point (e.g., 506A) may be positioned within an outer common area (e.g., 512A) of speaker spider 500. Similarly, outer ends of threads associated with anchor point 506TT may be positioned within outer common area 512TT which is near or along outer dimension or edge 504 and within vicinity of the associated anchor point 506TT. Because common areas 512 (e.g., 512A . . . 512VV) (not all outer common areas are explicitly shown) are associated with anchor points, distribution of common areas 512 around the outer edge 504 may be the same as and/or correspond to distribution of the outer anchor points 506.

D. Example Aspects of Speaker Spiders

Figure 6:
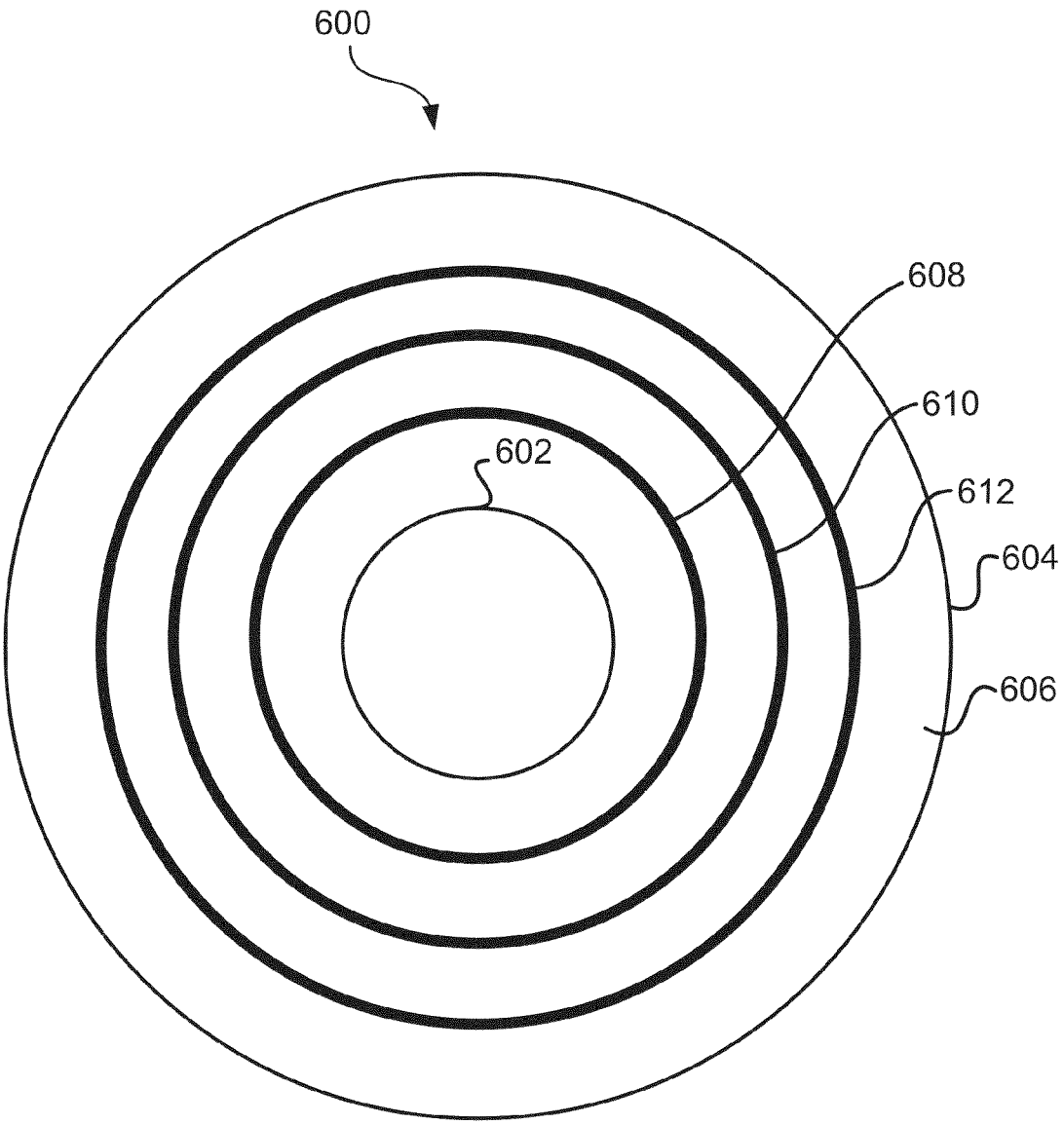
FIG. 6 shows a corrugation aspect of a speaker spider according to aspects described herein.

FIG. 6 illustrates a corrugation aspect of a speaker spider 600 according to aspects described herein. The woven pattern of speaker spider 600 may be any of speaker spiders 200, 300, 400, 500 and/or any combination of speaker spiders 200, 300, 400, 500. Speaker spider 600 is shown in FIG. 6 with a central opening, but in some embodiments might not have a central opening. In combining patterns of different speaker spiders, speaker spiders 200, 300, 400, 500 may be overlaid on each other as different layers. In addition to the woven patterns, speaker spider 600 may have one or more corrugations. Corrugations 608, 610, 612, may be corrugations as described in U.S. patent application Ser. No. 14/448,942 filed Jul. 31, 2014 (U.S. Publication No. 2016/0037264), which is hereby incorporated by reference in its entirety.

During the weaving process, inner anchor points and/or outer anchor points may be located on rigid circular frames (e.g., plastic frame, metal frame) for weaving. The anchor points may be in the form of posts on the frame or other fastening means (e.g., slot in the frame). The inner frame and/or outer frame may be integrated into the transducer apparatus. For example, the outer frame may be integrated into frame or basket 102. The frames may be used in the stiffening agent application process to ensure that the textile material remains flat when applying the stiffening agent and/or when excess stiffening agent is removed from the textile material after application. As described herein, the speaker spiders 200, 300, 400, 500, 600 may be removed from the weaving frame.

Various types of yarn may be used for the threads of the weaving patterns described herein for speaker spiders 300, 400, 500, 600. Any natural or synthetic yarn may be used for the threads of the weaving patterns, for example, cotton, polyester, Nomex, Conex. Combinations of different natural and/or synthetic yarns may be used. The particular type(s) of yarn used may depend on cost and/or stress-level of the design. Example stresses taken into consideration in selecting the type of yarn used may include mechanical, environmental, thermal, etc.

The weaving patterns described herein may be used for speaker spiders of any size which are commonplace in the industry today. Some example dimensions for speaker spider 300, 400, 500, 600 may include a diameter from approximately 0.5 inches to 5 inches for the central opening. The diameter (e.g., diameter 412) of speaker spiders 300, 400, 500, 600 may range from approximately 2 inches to 8 inches and be greater than the central opening diameter. Any combination of central opening diameter and diameter of the speaker spider 300, 400, 500, 600 may be used.

While speaker spiders 300, 400, 500 may be described with one layer of weaving, more than one layer of the weaving pattern may be used. Different combinations of weaving patterns may be used when more than one layer is used. For example, a speaker spider may have a layer of the weaving pattern from speaker spider 300 and a layer of the weaving pattern from speaker spider 500. Any combination of weaving patterns may be used.

E. Example Method

Figure 7:
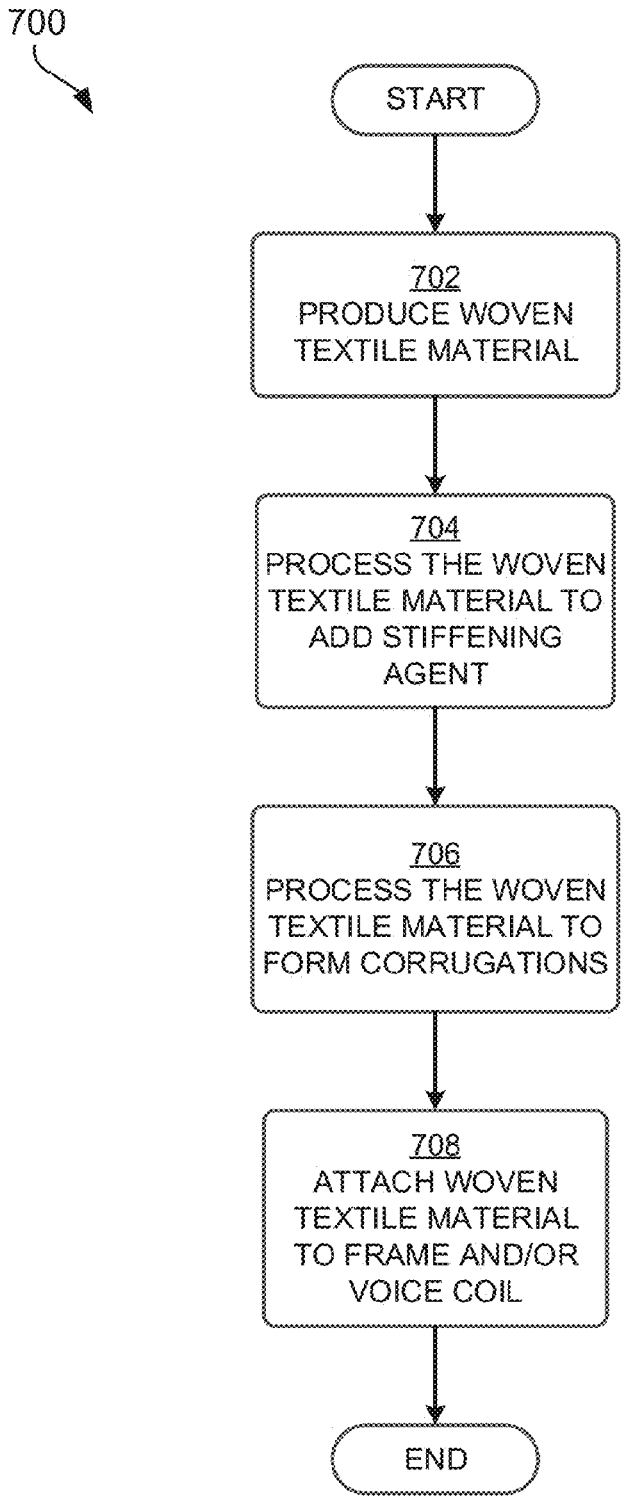
FIG. 7 illustrates an example flow chart for a method according to aspects described herein.

FIG. 7 shows a flowchart of an example method 700 of implementing a speaker spider 200, 300, 400, 500, 600 according to aspects described herein. At block 702, threads may be woven to form the various textile weave patterns described herein for speaker spiders 200, 300, 400, 500, 600. At block 704, the woven fabric or textile may be processed to add a stiffening agent. Prior to, in conjunction with, or after applying a stiffening agent, the woven fabric or textile may be removed from the outer frame while maintaining tension in the threads of the woven pattern to prevent unraveling of the woven threads. For example, the woven fabric or textile may be trimmed to or approximately to final inner dimensions and/or outer dimensions. As another example, the edges of the speaker spider around the outer dimension may be pinched to hold the threads in place while simultaneously cutting threads at the points which intersect with the outer dimension to separate the threads from a weaving frame. The outer dimension of the speaker spiders may be located within a circular frame formed by the plurality of outer anchor points.

In some embodiments, speaker spiders may have a central opening and an inner dimension. In some embodiments, the inner dimension may be formed by the threads of the weaving pattern in aggregate. In yet other embodiments, the speaker spider may be separated from the weaving frame by cutting the threads at points which intersect with the inner dimension.

The threads of the textile material of speaker spiders 200, 300, 400, 500, and 600 may be permanently stabilized or locked in place using a stiffening agent (e.g., phenolic resin). The stiffening agent may be applied to stiffen each individual thread to lock in the position of the thread within the weaving and prevent the weaving pattern from unraveling. For example, the woven textile material may be dipped or submerged in the liquid stiffening agent and then strained to remove excess resin. Excess resin may be removed sending the damp textile material through one or more rollers. The rollers may also further flatten the textile material.

At block 706, the woven textile material may be shaped to include corrugations as discussed with respect to FIG. 6. The flexible, dipped textile material may be placed into a forming heat-press to re-shape the flat fabric or textile material and to add the corrugations described herein. The corrugations may be stamped into the fabric. The heat-press semi-cures the resin to add stiffness to the fabric and form the corrugations. In particular, the heat of the hot-forming press partially cures the stiffening agent.

At block 708, the speaker spider can be coupled or attached to frame 102 and/or voice coil 106. For instance, the outer dimension of the speaker spider may be glued or otherwise fastened to frame or basket 102 of the transducer apparatus. The inner dimension of the speaker spider may be attached to voice coil 106 such that speaker spider allows movement of the voice coil, for example, along an axis orthogonal to the speaker spider.

Method 700 enables the step where inner dimension and/or outer dimensions of the speaker spider are formed to be combined with another step or omitted for better manufacturing efficiency. In some embodiments, because the threads in aggregate form the inner dimension of the speaker spider (e.g., speaker spiders 200, 400, 500, 600), a step to form the inner dimension by punching a hole in the center of the speaker spider is not necessary. Furthermore, because the speaker spiders may be woven within a circular framework, the threads of the speaker spiders may naturally conform to the shape of the speaker spider.

Method 700 shown in FIG. 7 presents an embodiment of a method that can be implemented within an operating environment involving, for example, the transducer apparatus 100 of FIG. 1, one or more of the playback device 800 of FIG. 8 which will be described in more detail herein, and one or more of the speaker spiders 300, 400, 500, 600 of FIGS. 3-6, respectively. Method 700 may include one or more operations, functions, or actions as illustrated by one or more of blocks 702-708. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 700 and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

IV. Example Playback Device

Figure 8:
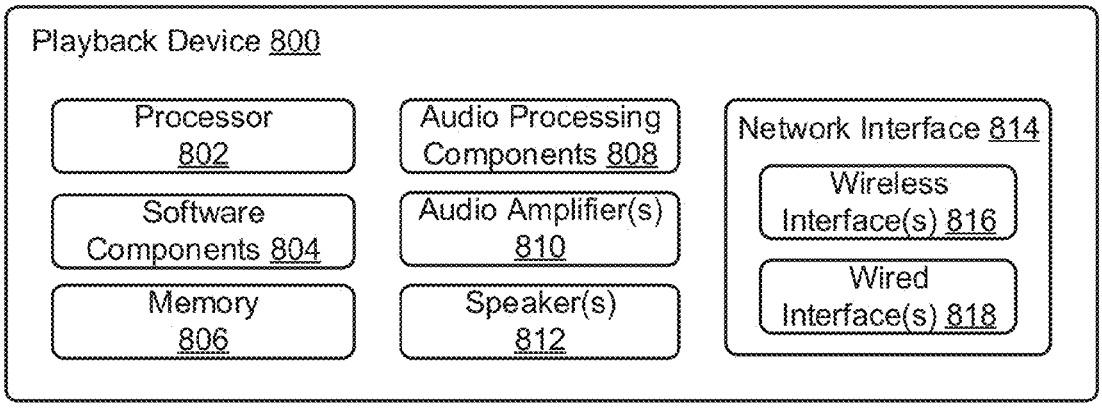
FIG. 8 shows a functional block diagram of a playback device according to aspects described herein.

FIG. 8 shows a functional block diagram of an example playback device 800 that may be part of a media playback system. The playback device 800 may include a processor 802, software components 804, memory 806, audio processing components 808, audio amplifier(s) 810, speaker(s) 812, and a network interface 814 including wireless interface(s) 816 and wired interface(s) 818. In one case, the playback device 800 may not include the speaker(s) 812, but rather a speaker interface for connecting the playback device 800 to external speakers. In another case, the playback device 800 may include neither the speaker(s) 812 nor the audio amplifier(s) 810, but rather an audio interface for connecting the playback device 800 to an external audio amplifier or audio-visual receiver.

In one example, the processor 802 may be a clock-driven computing component configured to process input data according to instructions stored in the memory 806. The memory 806 may be a tangible computer-readable medium configured to store instructions executable by the processor 802. For instance, the memory 806 may be data storage that can be loaded with one or more of the software components 804 executable by the processor 802 to achieve certain functions. In one example, the functions may involve the playback device 800 retrieving audio data from an audio source or another playback device. In another example, the functions may involve the playback device 800 sending audio data to another device or playback device on a network. In yet another example, the functions may involve pairing of the playback device 800 with one or more playback devices to create a multi-channel audio environment.

Certain functions may involve the playback device 800 synchronizing playback of audio content with one or more other playback devices. During synchronous playback, a listener will preferably not be able to perceive time-delay differences between playback of the audio content by the playback device 800 and the one or more other playback devices. U.S. Pat. No. 8,234,395 entitled, "System and method for synchronizing operations among a plurality of independently clocked digital data processing devices,"

which is hereby incorporated by reference, provides in more detail some examples for audio playback synchronization among playback devices.

The memory 806 may further be configured to store data associated with the playback device 800, such as one or more zones and/or zone groups the playback device 800 is a part of, audio sources accessible by the playback device 800, or a playback queue that the playback device 800 (or some other playback device) may be associated with. The data may be stored as one or more state variables that are periodically updated and used to describe the state of the playback device 800. The memory 806 may also include the data associated with the state of the other devices of the media system, and shared from time to time among the devices so that one or more of the devices have the most recent data associated with the system. Other embodiments are also possible.

The audio processing components 808 may include one or more digital-to-analog converters (DAC), an audio preprocessing component, an audio enhancement component or a digital signal processor (DSP), and so on. In one embodiment, one or more of the audio processing components 808 may be a subcomponent of the processor 802. In one example, audio content may be processed and/or intentionally altered by the audio processing components 808 to produce audio signals. The produced audio signals may then be provided to the audio amplifier(s) 810 for amplification and playback through speaker(s) 812. Particularly, the audio amplifier(s) 810 may include devices configured to amplify audio signals to a level for driving one or more of the speakers 812. The speaker(s) 812 may include an individual transducer (e.g., a "driver") or a complete speaker system involving an enclosure with one or more drivers. A particular driver of the speaker(s) 812 may include, for example, a subwoofer (e.g., for low frequencies), a mid-range driver (e.g., for middle frequencies), and/or a tweeter (e.g., for high frequencies). In some cases, each transducer in the one or more speakers 812 may be driven by an individual corresponding audio amplifier of the audio amplifier(s) 810. In addition to producing analog signals for playback by the playback device 800, the audio processing components 808 may be configured to process audio content to be sent to one or more other playback devices for playback.

Audio content to be processed and/or played back by the playback device 800 may be received from an external source, such as via an audio line-in input connection (e.g., an auto-detecting 3.5 mm audio line-in connection) or the network interface 814.

The network interface 814 may be configured to facilitate a data flow between the playback device 800 and one or more other devices on a data network. As such, the playback device 800 may be configured to receive audio content over the data network from one or more other playback devices in communication with the playback device 800, network devices within a local area network, or audio content sources over a wide area network such as the Internet. In one example, the audio content and other signals transmitted and received by the playback device 800 may be transmitted in the form of digital packet data containing an Internet Protocol (IP)-based source address and IP-based destination addresses. In such a case, the network interface 814 may be configured to parse the digital packet data such that the data destined for the playback device 800 is properly received and processed by the playback device 800.

As shown, the network interface 814 may include wireless interface(s) 816 and wired interface(s) 818. The wireless interface(s) 816 may provide network interface functions for the playback device 800 to wirelessly communicate with other devices (e.g., other playback device(s), speaker(s), receiver(s), network device(s), control device(s) within a data network the playback device 800 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 818 may provide network interface functions for the playback device 800 to communicate over a wired connection with other devices in accordance with a communication protocol (e.g., IEEE 802.3). While the network interface 814 shown in FIG. 2 includes both wireless interface(s) 816 and wired interface(s) 818, the network interface 814 may in some embodiments include only wireless interface(s) or only wired interface(s).

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (i.e. a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

I claim:

1. An apparatus, comprising:

an outer edge defining an outer perimeter; and a textile material formed of a woven pattern and comprising a plurality of concentric corrugations configured to allow movement of a loudspeaker component coupled to the textile material, the woven pattern comprising interwoven threads, each interwoven thread extending between an inner point and a distributed point along the outer edge, the interwoven threads comprising pairs of weft threads, each pair of weft threads having outer ends positioned within an outer common area along the outer edge, and each weft thread extending along a radius of the apparatus.

2. The apparatus of claim 1, further comprising:

a central opening defining an inner perimeter, wherein each pair of weft threads has inner ends positioned within an inner common area along the inner perimeter.

3. The apparatus of claim 2, wherein the interwoven threads comprise one or more warp threads, wherein the inner perimeter is defined by an innermost warp thread, and wherein the outer edge is defined by an outermost warp thread.

4. The apparatus of claim 1, wherein the interwoven threads comprise one or more warp threads.

5. The apparatus of claim 4, wherein the one or more warp threads is woven through the pairs of weft threads substantially concentrically.

6. A transducer apparatus, comprising:

a loudspeaker component; and a speaker spider comprising:

an outer edge defining an outer perimeter; and a textile material formed of a woven pattern and comprising a plurality of concentric corrugations configured to allow movement of a loudspeaker component coupled to the textile material, the woven pattern comprising interwoven threads, each interwoven thread extending from an inner point to a distributed point along the outer edge, the interwoven threads comprising pairs of weft threads, each pair of weft threads having outer ends positioned within an outer common area along the outer edge, and each weft thread extending along a radius of the transducer apparatus.

7. The transducer apparatus of claim 6, wherein the speaker spider further comprises:

a central opening defining an inner perimeter, wherein each pair of weft threads has inner ends positioned within an inner common area along the inner perimeter.

8. The transducer apparatus of claim 7, wherein the loudspeaker component comprises:

a voice coil, wherein the voice coil is disposed within the central opening and coupled to the inner perimeter of the speaker spider.

9. The transducer apparatus of claim 7, wherein the interwoven threads comprise one or more warp threads, wherein the inner perimeter is defined by an innermost warp thread, and wherein the outer edge is defined by an outermost warp thread.

10. The transducer apparatus of claim 6, wherein the loudspeaker component comprises:

a voice coil, wherein the voice coil is coupled to the outer edge of the speaker spider.

11. The transducer apparatus of claim 6, wherein the loudspeaker component comprises:

a spacer, wherein the spacer is attached to a center of the speaker spider on one side of the speaker spider.

12. The transducer apparatus of claim 6, further comprising:

a frame coupled to the outer perimeter of the speaker spider.

13. A method, comprising:

providing a textile material formed of a woven pattern, the woven pattern comprising interwoven threads extending between an inner point and a distributed point along an outer perimeter, the interwoven threads comprising pairs of weft threads, each pair of weft threads having outer ends positioned within an outer common area along the outer perimeter, and each weft thread extending along a radius of a transducer apparatus;

processing the textile material to form a plurality of concentric corrugations configured to allow movement of a loudspeaker component coupled to the textile material; and coupling the textile material to a voice coil.

14. The method of claim 13, further comprising:

applying a stiffening agent to the textile material while the textile material is attached to an outer frame.

15. The method of claim 13, wherein coupling the textile material comprises:

coupling an inner perimeter of the textile material to the voice coil, wherein a central opening of the textile material defines the inner perimeter; and coupling the outer perimeter of the textile material to a frame.

* * * * *